US006217257B1

(12) United States Patent
Garofalo et al.

(10) Patent No.: US 6,217,257 B1
(45) Date of Patent: Apr. 17, 2001

(54) BALANCING JACKET WITH A PLURALITY OF CONNECTED DISCHARGE VALVES FOR SCUBA DIVERS

(75) Inventors: Giovanni Garofalo, Rapallo; Alberto Belloni, Recco, both of (IT)

(73) Assignee: HTM Sport S.p.A. (IT)

( * ) Notice: Subject to any disclaimer, the term of this patent is extended or adjusted under 35 U.S.C. 154(b) by 0 days.

(21) Appl. No.: 09/188,223

(22) Filed: Nov. 9, 1998

(30) Foreign Application Priority Data

Dec. 3, 1997 (IT) ..... GE97A0101

(51) Int. Cl.[7] ..... B63C 11/02
(52) U.S. Cl. ..... 405/186; 441/92
(58) Field of Search ..... 405/186, 185; 441/86, 106, 88, 92, 96, 102, 108; 4/2.15; 114/315

(56) References Cited

U.S. PATENT DOCUMENTS 3,046,576 * 7/1962 Bernhardt ..... 441/92
4,000,534 1/1977 Cerniway et al. ..... 405/186
4,289,163 9/1981 Pierson .
4,720,281 * 1/1988 Matsuoka ..... 405/186
5,980,158 * 11/1999 Griffiths et al. ..... 405/186

FOREIGN PATENT DOCUMENTS 93 12 321 U 1/1994 (DE) .
2 623 465 5/1989 (FR) .

* cited by examiner

*Primary Examiner*—Eileen D. Lillis
*Assistant Examiner*—Sunil Singh
(74) *Attorney, Agent, or Firm*—Larson & Taylor, PLC

(57) ABSTRACT

A balancing jacket for scuba divers includes at least two valves for discharge of air. All the valves are connected to a pneumatic-control pipe, and preferably at least one of the valves is located in the bottom part of the balancing jacket and at least one in the top part. The air-discharge valves are air valves of the open-close type with spring-operated return combined with non-return valves to prevent any entry of water into the jacket.

6 Claims, 2 Drawing Sheets

BALANCING JACKET WITH A PLURALITY OF CONNECTED DISCHARGE VALVES FOR SCUBA DIVERS

BACKGROUND AND SUMMARY OF THE INVENTION

The present invention refers to a system for the pneumatic opening of the valves for discharging air present in balancing jackets.

Balancing jackets for scuba divers have the purpose of enabling stable positioning of the diver at the desired depth. This is obtained by regulating the air contained inside the bag. In fact, if the diver wants to remain stable at a certain depth, he discharges some of the air from the jacket by operating a discharge valve until the desired amount of fluid remains inside the bag. Generally this valve is located in the top part of the balancing jacket, and thus enables discharge of air only when the diver is in a vertical position with his head at a higher depth than his feet. This therefore constitutes a limitation; in fact, if the diver has his head higher than his legs, as for instance, in the case where he is carrying out speleology, the valve can no longer discharge the air because it is in the part of the balancing jacket that is at the greater depth, and consequently in the part where there is no air since the jacket is generally not completely inflated.

Furthermore, balancing jackets are known which are provided with two valves for discharging air, located at the top of the jacket. However, these valves must be operated individually, and this, in the case, for example, of fast ascent, is not always convenient.

Consequently, the main aim of the present invention is to provide a system of pneumatic opening of valves for discharging air which carries out opening of all the discharge valves of the jacket by operating a single control element.

In the specific case where the two discharge valves are both located in just one part of the balancing jacket, the advantage is obtained of a faster discharge of the air from the jacket.

Instead, in the case where the balancing jacket contains one (or more) discharge valves located in the top part and one or more discharge valves located in the bottom part, all connected to the air-discharge system, when the single discharge control is operated, which is generally a push-button, the user is sure that at least one valve will discharge, whatever his position may be. At the same time he must be also sure that through the valve or valves that cannot discharge air, water may not get in through them.

To overcome this problem, according to the invention the air-discharge valves are combined with one way valves, so that if any air is present, it goes out, whereas water cannot get inside in any case.

BRIEF DESCRIPTION OF THE DRAWINGS

The invention will now be described in greater detail, with reference to the figures attached, where.

DESCRIPTION OF THE PREFERRED EMBODIMENT OF THE INVENTION

Figure 1:
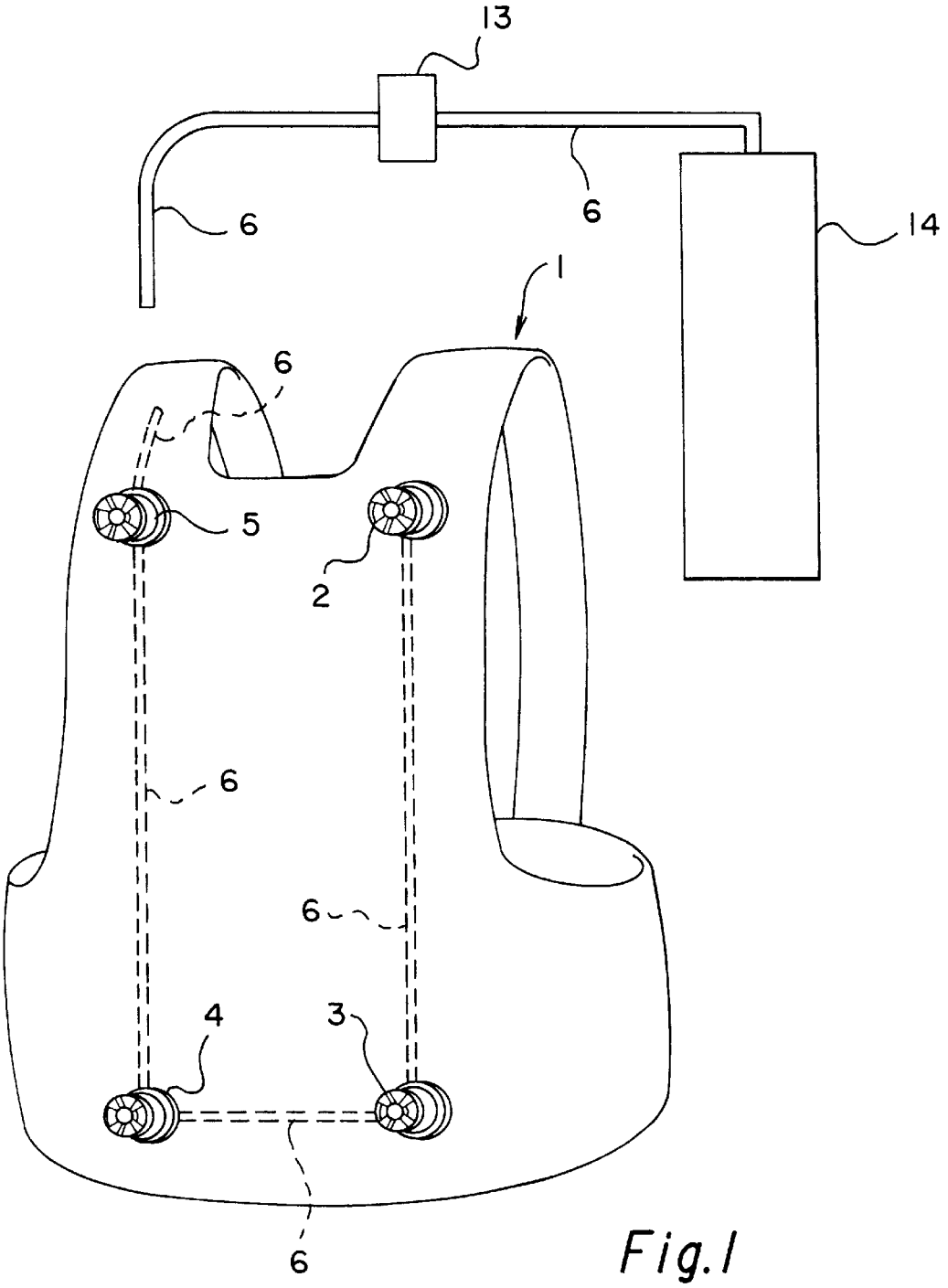
FIG. 1 shows a balancing jacket according to the invention.

FIG. 1 illustrates a balancing jacket 1 containing four valves 2–5 for discharging the air present in the jacket. The valves are connected to a pneumatically-controlled pipe 6. The pipe may be either internal or external to the balancing jacket and connects all the valves in such a way that when the diver operates the discharge button, it delivers compressed air, simultaneously opening all the valves for discharge. When no more air is delivered, the valves close. In this embodiment, four valves are present, even though operation is guaranteed even when only two valves are present, for example valve 2 and valve 4. In fact, it is sufficient for there to be present just one bottom valve and one top valve to guarantee discharge of air when the diver is in a vertical position, whether head downwards or head upwards. The presence of the four valves makes it possible to accelerate discharge of the air: since the valves operate in pairs, they discharge a double amount of air flow. In addition, the presence of the four valves enables regulation even when the diver is in an oblique position.

Figure 2:
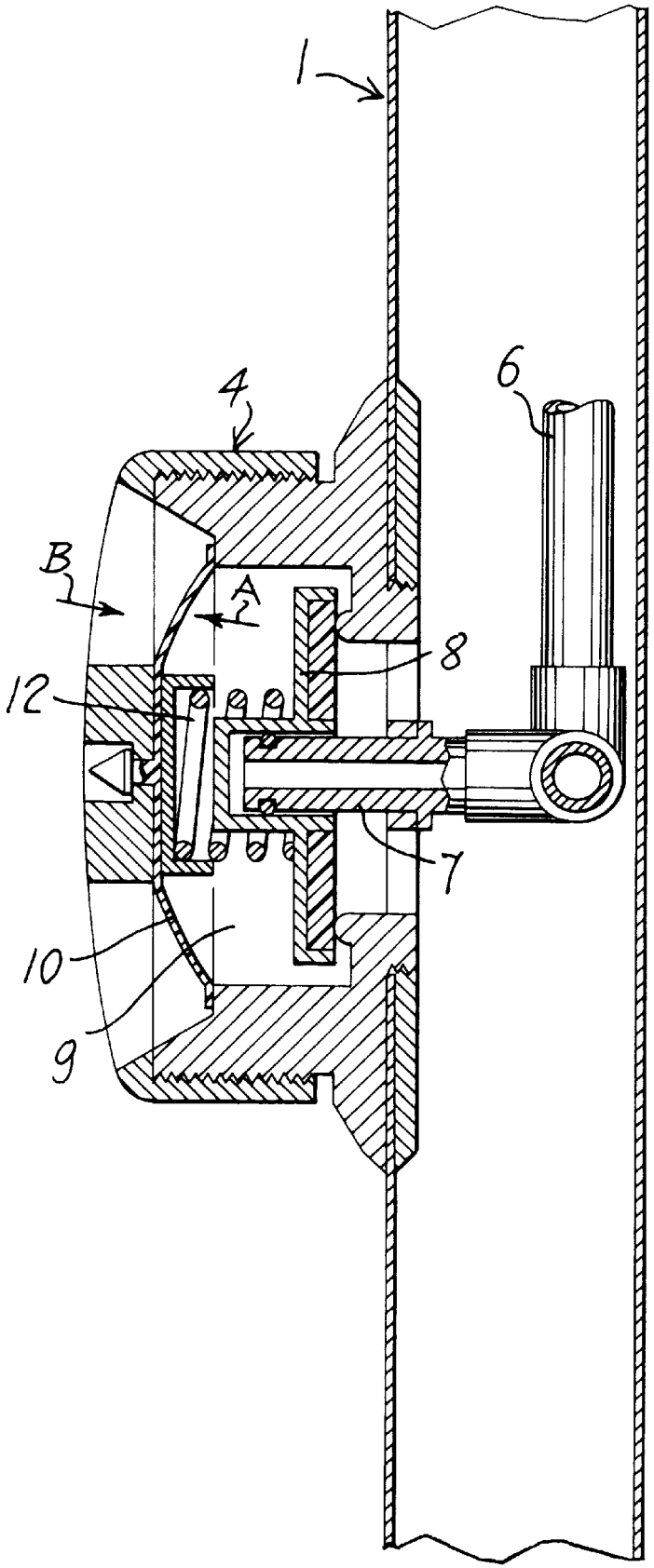
FIG. 2 presents a side, partially cross-sectional, view of a valve according to the invention.

FIG. 2 illustrates one of the valves 2–5. Unless the balancing jacket is completely inflated, a circumstance which is extremely rare, there is no air in the part of the bag that is at the greater depth. Consequently, when the valves open for discharging air, water, which is not impeded by the flow of air coming out, can come in through the valves located in that part. To get around this problem, the valves according to the invention are made up of one open-close pneumatic part and one one way part.

When the diver operates the push-button 13 for discharging the air, compressed air from a tank 14 is sent through the pneumatic opening control 7, and the element 8 of the valve rises, so allowing the air present inside to exit from the balancing jacket 1. The air enters the chamber 9 and pushes the diaphragm 10 in the direction of the arrow A. The pressure exerted by the air is greater than the pressure of the water moving in the direction of the arrow B, and consequently the flow of air is directed outwards. When the pneumatic control 7 ceases to send out compressed air, under the action of the spring 12 the element 8 closes the valve again.

If no air is present at the valve, the pneumatic control lifts the element 8 in any case, but the diaphragm 10 does not move because there is not sufficient pressure inside the chamber 9 to withstand the external pressure of the water. In this way, the water is prevented from entering the balancing jacket.

Obviously, even though a balancing jacket provided with four discharge valves set in pairs at the top and at the bottom of the jacket is illustrated and described, it remains understood that the invention equally comprises a balancing jacket provided with only two valves, both set in the same part of the jacket (top and/or bottom).

What is claimed is:

1. A balancing jacket for scuba divers comprising at least two valves for discharge of air, a discharge control and a pneumatic-control pipe connecting said valves such that said valves are simultaneously operable by said discharge control.

2. A balancing jacket for scuba divers according to claim 1, wherein at least one of the said valves is located in a bottom part of the balancing jacket and at least one of said valves is located in a top part of said jacket.

3. A balancing jacket according to claim 1, wherein said air-discharge valves comprise air valves of the open-close type with return operated by an elastic element and are combined with non-return valves.

4. A balancing jacket according to claim 3, wherein said air-discharge valves comprise a shutter element which lifts up from its seat, counteracting the elastic element, when compressed air is delivered by a pneumatically opening control, and a diaphragm which lifts up from its seat only if the pressure inside a chamber is higher than the external pressure.

5. A balancing jacket according to claim 4, wherein said pipe that connects the series of valves is either inside or outside the balancing jacket.

6. A balancing jacket according to claim 5, wherein the air-discharge valves preferably comprise two at the bottom of the jacket and two at the top of the jacket.

* * * * *